US005511390A

United States Patent [19]

Mah

[11] Patent Number: 5,511,390

[45] Date of Patent: Apr. 30, 1996

[54] PENDANT LOCKET HOLDER FOR KEYS AND OTHER ARTICLES

[76] Inventor: Mon Dod Mah, 1316 E. 64th Avenue, Vancouver B.C., Canada, V5X 2P1

[21] Appl. No.: 289,430

[22] Filed: Aug. 12, 1994

[51] Int. Cl.[6] ..... A44L 13/00; A45L 11/32

[52] U.S. Cl. ..... 63/1.1; 63/19; 70/456 R; 206/38.1; 206/37.1; 206/37.4; 206/811

[58] Field of Search ..... 232/1.1, 19; 70/456 R, 70/459; 206/472, 38.1, 37.1, 37.4, 811

[56] References Cited

U.S. PATENT DOCUMENTS

| | | | |
|---|---|---|---|
| 1,692,041 | 11/1928 | Klein | 206/811 |
| 2,596,716 | 5/1952 | Otten | 206/37.1 |
| 2,849,044 | 8/1958 | Reitzel | 206/37.1 |
| 3,346,099 | 10/1967 | Thong | 206/811 |
| 3,587,262 | 6/1971 | Kaye | 70/456 R |
| 3,926,234 | 12/1975 | Dean | 206/37.4 |
| 3,955,726 | 5/1976 | Reitzel | 63/19 |
| 4,048,824 | 9/1977 | Blackmon | 70/456 R |
| 4,890,742 | 6/1990 | Allison | 206/811 |

FOREIGN PATENT DOCUMENTS

| | | | |
|---|---|---|---|
| 349699 | 6/1931 | United Kingdom | 206/811 |

*Primary Examiner*—Flemming Saether
*Attorney, Agent, or Firm*—Micheal I. Kroll

[57] ABSTRACT

A pendant locket holder for keys and other articles comprising a casing being a pair of complementary half-sections with each half-section having a recessed chamber. An element flexibly connects the longitudinal edges of the half-sections together. The half-sections may be moved from a substantially coplanar relationship in an open position of the casing to a closed position, wherein the half-sections are in a juxtaposed relationship. An assembly on the opposite longitudinal edges of the half-sections is for releasably holding the same in the juxtaposed relationship, when the casing is in the closed position. A component is formed within each recessed chamber in each half-section of the casing for retaining the keys and other articles therein. A structure is for suspending the casing from about the neck of a person, so that the person will always maintain access to the keys and other articles held within the retaining components in the casing.

8 Claims, 2 Drawing Sheets

PENDANT LOCKET HOLDER FOR KEYS AND OTHER ARTICLES

BACKGROUND OF THE INVENTION

1. Field of the Invention

The instant invention relates generally to key retainers and more specifically it relates to a pendant locket holder for keys and other articles.

2. Description of the Prior Art

Numerous key retainers have been provided in prior art. For example, U.S. Pat. Nos. 3,464,244 to Hinkel et al.; 4,320,641 to Toyoda; 4,637,236 to Almblad and 5,121,834 to Tissembaum all are illustrative of such prior art. While these units may be suitable for the particular purpose to which they address, they would not be as suitable for the purposes of the present invention as heretofore described.

SUMMARY OF THE INVENTION

A primary object of the present invention is to provide a pendant locket holder for keys and other articles that will overcome the shortcomings of the prior art devices.

Another object is to provide a pendant locket holder for keys and other articles that is worn about the neck as a fashionable ornament, as well as a place to neatly carry spare keys, money and writing instruments which are used for emergency purposes.

An additional object is to provide a pendant locket holder for keys and other articles that includes a casing being a pair of hinged complementary half sections which can be opened and closed, with each section having an internal pocket for receiving the keys and other articles therein, so as to protect them from dust and moisture.

A further object is to provide a pendant locket holder for keys and other articles that is simple and easy to use.

A still further object is to provide a pendant locket holder for keys and other articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
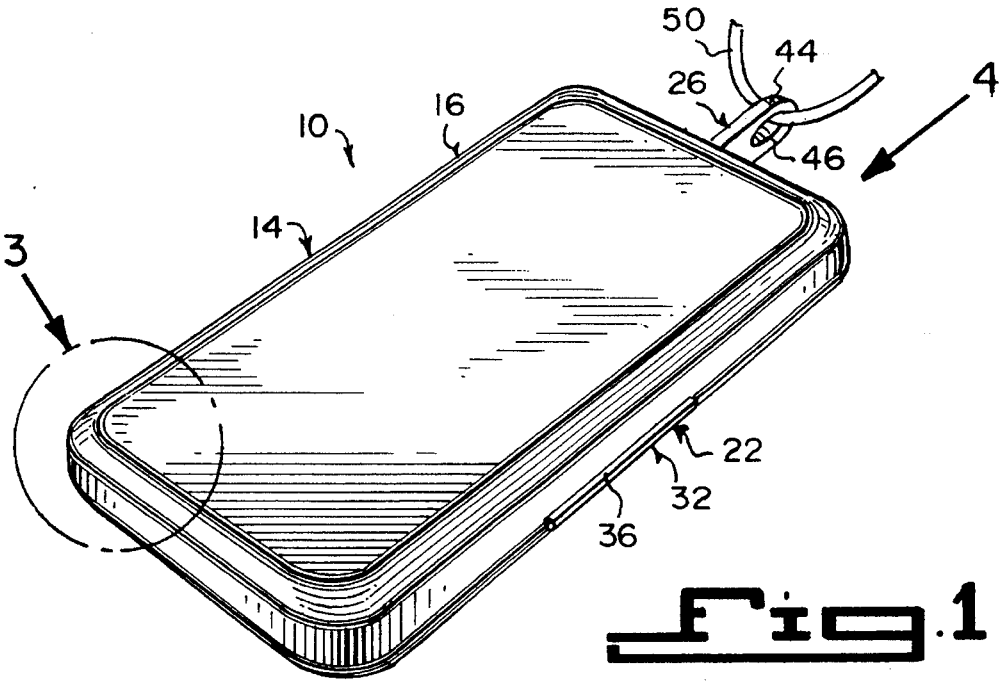
FIG. 1 is a perspective view of the instant invention in a closed position.
Figure 2:
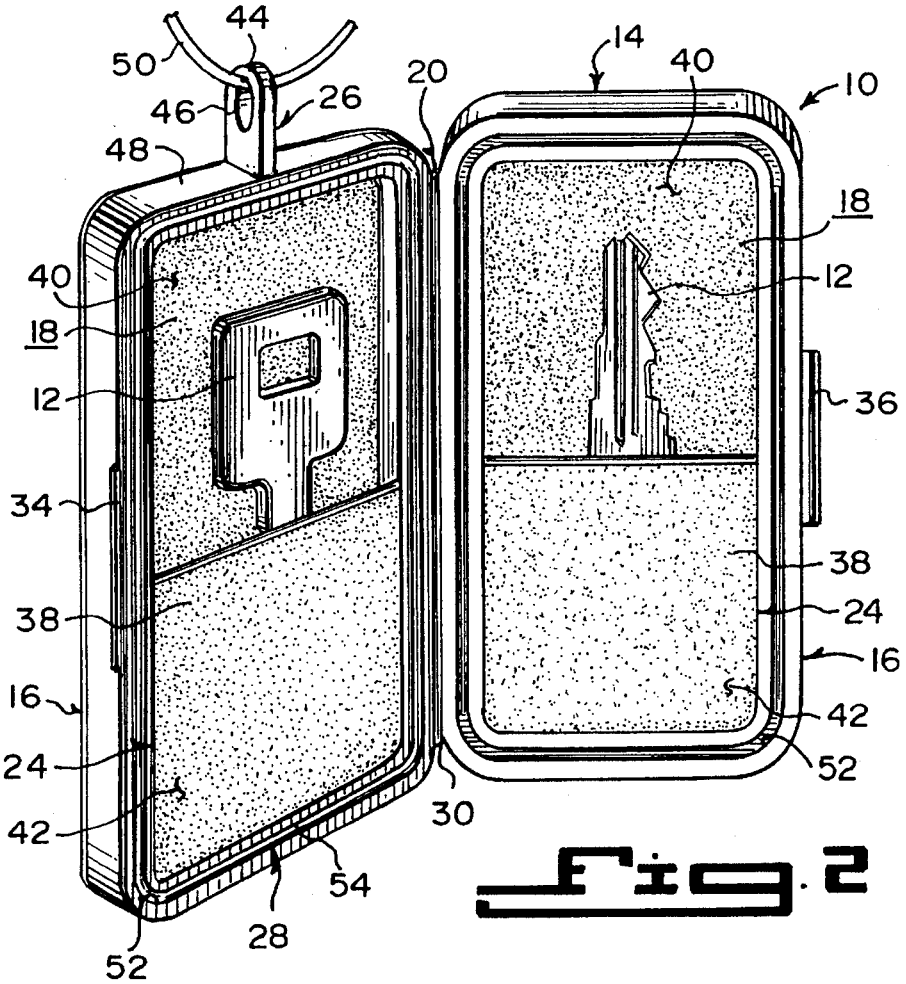
FIG. 2 is a perspective view of the instant invention in an opened position.
Figure 3:
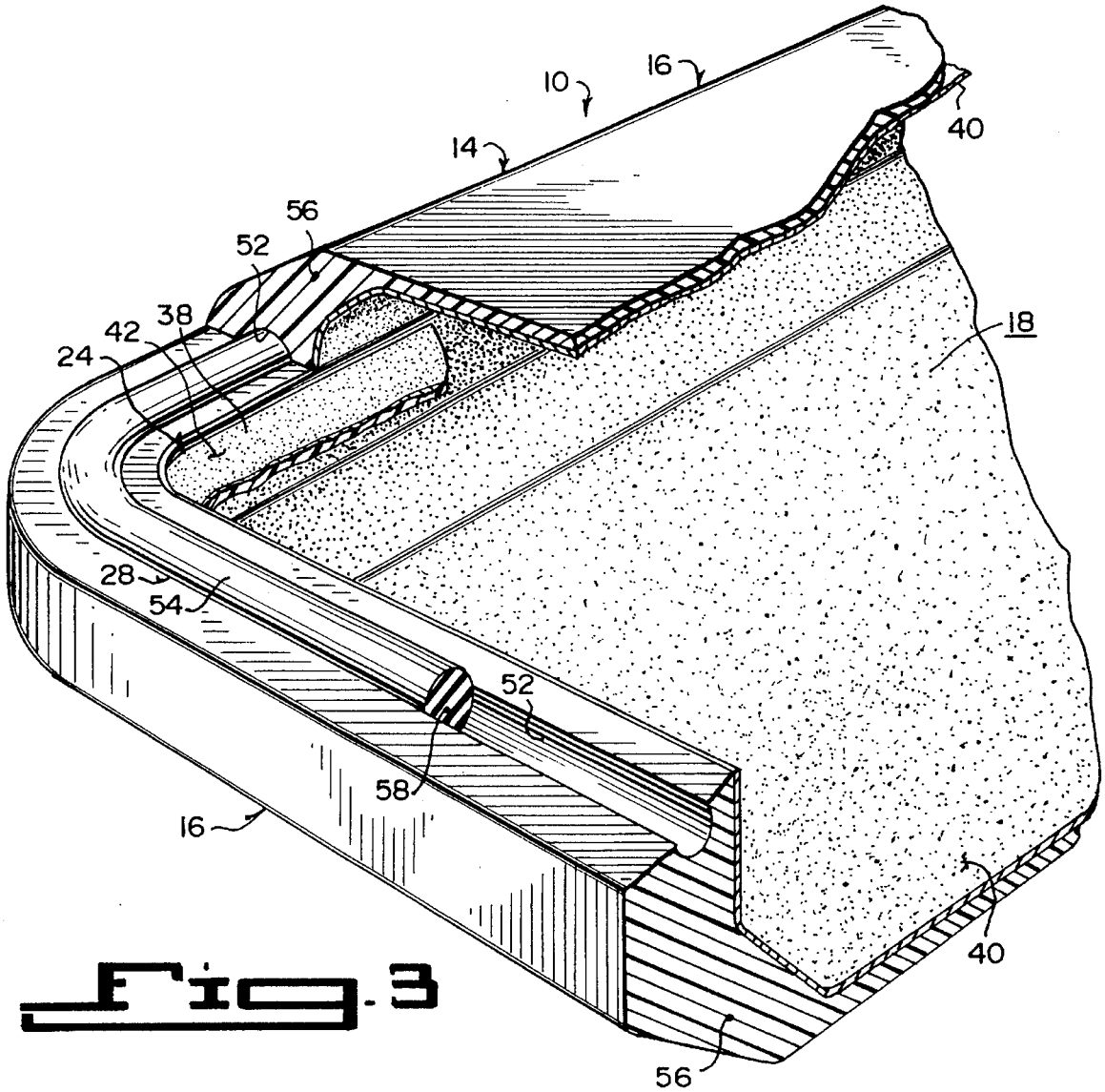
FIG. 3 is an enlarged perspective view of a portion thereof as indicated by arrow 3 in FIG. 1, with parts broken away and in section.
Figure 4:
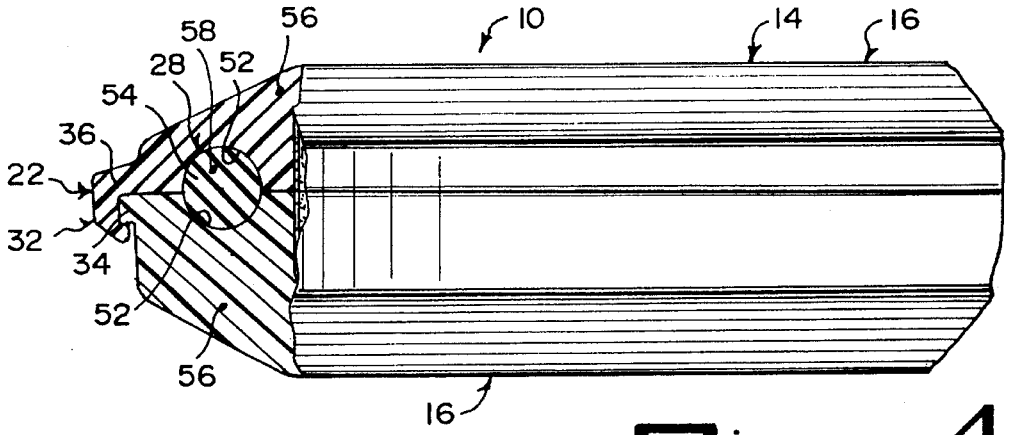
FIG. 4 is an enlarged elevational view taken in the direction of arrow 4 in FIG. 1, with parts broken away and in section.

Turning now descriptively to the drawings, in which similar reference characters denote similar elements throughout the several views, FIGS. 1 through 4 illustrate a pendant locket holder 10 for keys and other articles 12 comprising a casing 14 being a pair of complementary half-sections 16 with each half-section 16 having a recessed chamber 18. An element 20 flexibly connects the longitudinal edges of the half-sections 16 together. The half-sections 16 may be moved from a substantially coplanar relationship in an open position of the casing 14 to a closed position, wherein the half-sections 16 are in a juxtaposed relationship.

An assembly 22 on the opposite longitudinal edges of the half-sections 16 is for releasably holding the same in the juxtaposed relationship when the casing 14 is in the closed position. A component 24 is formed within each recessed chamber 18 in each half-section 16 of the casing 14 for retaining the keys and other articles 12 therein. A structure 26 is for suspending the casing 14 from about the neck of a person, so that the person will always maintain access to the keys and other articles 12 held within the retaining components 24 in the casing 14.

A unit 28 is for sealing the inner mating perimeters of the half-sections 16, when the casing 14 is in the closed position with the half-sections 16 in the juxtaposed relationship. The keys and other articles 12 will be protected from dust and moisture therein.

The flexible connecting element 20 is a hinge 30 integral with the longitudinal edges of the half-sections 16, to facilitate movement thereof between the open and closed positions of the casing 14.

The releasable holding assembly 22 is a snap-lock fastener 32 having a rib 34 projecting from one half-section 16 and a latch 36 projecting from the other half-section 16. When the casing 14 is in the closed position, the latch 36 will engage with the rib 34 to hold together the half-sections 16 in the juxtaposed relationship.

Each retaining component 24 is a pocket 38 covering about half of the recessed chamber 18 in one half-section 16 of the casing 14. The keys and other articles 12 can be inserted within the pockets 38.

The outer surface of each recessed chamber 18 in each half-section 16 of the casing 14 is covered with a liner 40, to protect the keys and other articles 12. An outer surface of each pocket 38 in each half-section 16 of the casing 14 is covered with a liner 42, to match up with the liner 40 in the respective recessed chamber 18 for an aesthetic appearance.

The suspending structure 26 is a tab 44 having an aperture 46 therethrough. The tab 44 is integral with and at a right angle to a top edge 48 of one half-section 16 of the casing 14. A lanyard 50, such as a chain or cord, can extend through the tab 44 and about the neck of the person, allowing the casing 14 to lie flat against the body of the person.

The sealing unit 28 includes each half-section 16 having a continuous groove 52 about the inner mating perimeter. A gasket 54 is secured into one groove 52, so that the gasket 54 will engage with the other groove 52, to prevent the dust and moisture from passing through when the half-sections 16 are in the juxtaposed relationship in the closed position.

The casing 14 is fabricated out of a durable strong material 56, which can be plastic. The gasket 54 is fabricated out of a compressible rubber material 58.

The pendant locket holder 10 can be manufactured without the sealing unit 28, in which the continuous grooves 52 about the inner mating perimeters of the half-sections 16 of the casing 14 and the gasket 54 are eliminated. This will be more economical for manufacturing purposes.

The pendant locket holder 10 can also include the incorporation of luxury features, such as electronics in one half-section 16 of the casing 14. For example, the electronics can be a timepiece with a variety of features, a limited memory phone directory, an electronic memo program, a light source and other additional features.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pendant locket holder for keys and other articles comprising:

a) a casing being a pair of complementary half-sections with each said half-section having a recessed chamber;

b) means flexibly connecting longitudinal edges of said half-sections together, whereby said half-sections may be moved from a substantially coplanar relationship in an open position of said casing to a closed position, wherein said half-sections are in a juxtaposed relationship, said flexible connecting means being a hinge integral with the longitudinal edges of said half-sections, to facilitate movement thereof between the open and closed positions of said casing;

c) means on opposite longitudinal edges of said half-sections, for releasably holding the same in the juxtaposed relationship when said casing is in the closed position, said releasable holding means being a snap-lock fastener having a rib protecting from one said half-section and a latch projecting from other said half-section, so that when said casing is in the closed position, said latch will engage with said rib to hold together said half-sections in the juxtaposed relationship;

d) means formed within each said recessed chamber in each said half-section of said casing for retaining the keys and other articles therein, each said retaining means being a pocket covering about half of said recessed chamber in one said half-section of said casing, so that the keys and other articles can be inserted within said pockets;

e) means for suspending said casing from about the neck of a person, so that the person will always maintain access to the keys and other articles held within said retaining means in said casing, and f) means for sealing the inner mating perimeters of said half-sections when said casing is in the closed position with said half-sections in the juxtaposed relationship, so that the keys and other articles will be protected from dust and moisture therein.

2. A pendant locket holder for keys and other articles as recited in claim 1, wherein an outer surface of each said recessed chamber in each said half-section of said casing is covered with a liner, to protect the keys and other articles.

3. A pendant locket holder for keys and other articles as recited in claim 2, wherein an outer surface of each said pocket in each said half-section of said casing is covered with a liner, to match up with said liner in said respective recessed chamber for an aesthetic appearance.

4. A pendant locket holder for keys and other articles as recited in claim 3, wherein said suspending means is a tab having an aperture therethrough, said tab integral with and at a right angle to a top edge of one said half-section of said casing, so that a lanyard can extend through said tab and about the neck of the person, allowing said casing to lie flat against the body of the person.

5. A pendant locket holder for keys and other articles as recited in claim 4, wherein said sealing means includes:

a) each said half-section having a continuous groove about the inner mating perimeter; and b) a gasket secured into one said groove, so that said gasket will engage with said other said groove to prevent the dust and moisture from passing through when said half-sections are in the juxtaposed relationship in the closed position.

6. A pendant locket holder for keys and other articles as recited in claim 5, wherein said casing is fabricated out of a durable strong material.

7. A pendant locket holder for keys and other articles as recited in claim 6, wherein said durable strong material is plastic.

8. A pendant locket holder for keys and other articles as recited in claim 6, wherein said gasket is fabricated out of a compressible rubber material.

* * * * *